US011459659B2

(12) United States Patent
Chen

(10) Patent No.: US 11,459,659 B2
(45) Date of Patent: Oct. 4, 2022

(54) NANOCRYSTALLINE MATERIAL BASED ON STAINLESS STEEL SURFACE, AND PREPARATION METHOD THEREFOR

(71) Applicant: SHENZHEN CANDORTECH INCORPORATED COMPANY, Shenzhen (CN)

(72) Inventor: Chao Chen, Shenzhen (CN)

(73) Assignee: SHENZHEN CANDORTECH INCORPORATED COMPANY, Shenzhen (CN)

( * ) Notice: Subject to any disclaimer, the term of this patent is extended or adjusted under 35 U.S.C. 154(b) by 763 days.

(21) Appl. No.: 16/326,171

(22) PCT Filed: Aug. 16, 2017

(86) PCT No.: PCT/CN2017/097657

§ 371 (c)(1),
(2) Date: Apr. 30, 2019

(87) PCT Pub. No.: WO2018/033097

PCT Pub. Date: Feb. 22, 2018

(65) Prior Publication Data

US 2019/0256982 A1 Aug. 22, 2019

(30) Foreign Application Priority Data

Aug. 16, 2016 (CN) ..... 201610675709.0

(51) Int. Cl.
*C25D 5/36* (2006.01)
*C25D 5/50* (2006.01)
(Continued)

(52) U.S. Cl.
CPC ..... *C23C 22/24* (2013.01); *C23C 22/78* (2013.01); *C25D 3/08* (2013.01); *C23F 1/40* (2013.01); *C23G 1/19* (2013.01)

(58) Field of Classification Search
CPC .. C25D 5/36; C25D 5/50; C25D 11/00; C23C 28/04
(Continued)

(56) References Cited

U.S. PATENT DOCUMENTS 4,586,957 A * 5/1986 Masumoto ..... C22C 45/02 148/325
2015/0090368 A1* 4/2015 Katayama ..... C23C 8/42 148/241
(Continued)

FOREIGN PATENT DOCUMENTS

CN 102691059 A * 9/2012 ..... C25D 11/00
CN 102965649 A * 3/2013 ..... C23C 22/07
WO WO-2015089062 A1 * 6/2015 ..... H01L 51/56

OTHER PUBLICATIONS

Meng et al., "Intermediate-Temperature Oxidation of Fe—Cr—Ni—Mo Stainless Maraging Steel in Air," Applied Mechanics and Materials (Sep. 2013), vols. 423-426, pp. 192-196. (Year: 2013).*
(Continued)

*Primary Examiner* — Edna Wong
(74) *Attorney, Agent, or Firm* — Lewis Roca Rothgerber Christie LLP

(57) ABSTRACT

A nanocrystalline material based on a stainless steel surface. In percentage by weight, the nanocrystalline material comprises: 0 to 3% of carbon, 20% to 35% of oxygen, 40% to 53% of chromium, 10% to 35% of ferrum, 0 to 4% of molybdenum, 1% to 4% of nickel, 0 to 2.5% of silicon, 0 to 2% of calcium, and the balance of impurity elements. Also disclosed is a preparation method for the nanocrystalline material, and the nanocrystalline material that is based on a stainless steel surface and that is prepared by using the preparation method.

15 Claims, 11 Drawing Sheets

(51) Int. Cl.

| | |
|---|---|
| ***C25D 11/00*** | (2006.01) |
| ***C23C 22/24*** | (2006.01) |
| ***C23C 22/78*** | (2006.01) |
| ***C25D 3/08*** | (2006.01) |
| *C23F 1/40* | (2006.01) |
| *C23G 1/19* | (2006.01) |

(58) Field of Classification Search
USPC ..... 205/106, 188, 218, 224
See application file for complete search history.

(56) References Cited

U.S. PATENT DOCUMENTS

2019/0186021 A1 6/2019 Chen
2019/0256982 A1 8/2019 Chen

OTHER PUBLICATIONS

Safikhani et al., "Effect of Ni—Mo Addition on Cyclic and Isothermal Oxidation Resistance and Electrical Behavior of Ferritic Stainless Steel for SOFCs Interconnect," International Journal of Hydrogen Energy (Jul. 15, 2014), vol. 39, No. 21, pp. 11210-11223. (Year: 2014).*

Ansari et al., "Improvement in the Corrosion Resistance of Stainless Steel 304L in Sodium Chloride Solution by a Nanoclay Incorporated Silane Coating," RSC Advances (2015), vol. 5, No. 1, pp. 706-716. (Year: 2015).*

Carrillo et al., "Electrochemical Study of Oxyanions Effect on Galvanic Corrosion Inhibition," Int. J. Electrochem. Sci. (Sep. 1, 2012), vol. 7, No. 9, pp. 8688-8701. (Year: 2012).*

Jung et al., "XPS Characterization of Passive Films Formed on Type 304 Stainless Steel in Humid Atmosphere," Corrosion Science (May 1, 2012), vol. 58, pp. 62-68. (Year: 2012).*

Qiu, "Passivity and Its Breakdown on Stainless Steels and Alloys," Surface and Interface Analysis: An International Journal Devoted to the Development and Application of Techniques for the Analysis of Surfaces, Interfaces and Thin Films (Oct. 2002), vol. 33, Nos. 10-11, pp. 830-833. (Year: 2002).*

Mandrino et al.,"Study of Oxide Protective Layers on Stainless Steel by AES, EDS and XPS," Surface and Interface Analysis: An International Journal Devoted to the Development and Application of Techniques for the Analysis of Surfaces, Interfaces and Thin Films (Mar. 2008), vol. 40 (3-4), pp. 285-289. (Year: 2008).*

Carmezim et al., "Electrochemical Behaviour of Thermally Treated Cr-Oxide Films Deposited on Stainless Steel," Corrosion Science (Mar. 1, 2002), vol. 44, No. 3, pp. 451-465. (Year: 2002).*

Qinq, "Colouring of Stainless Steel and its Application," Electroplating & Finishing (Dec. 1993), vol. 12, No. 4, pp. 52-59. (Year: 1993).

* cited by examiner

NANOCRYSTALLINE MATERIAL BASED ON STAINLESS STEEL SURFACE, AND PREPARATION METHOD THEREFOR

CROSS-REFERENCE TO RELATED APPLICATION(S)

This application is a U.S. National Phase Patent Application of International Application Number PCT/CN2017/097657, filed on Aug. 16, 2017, which claims priority of Chinese Patent Application Number 201610675709.0, filed on Aug. 16, 2016, the entire contents of all of which are incorporated herein by reference.

TECHNICAL FIELD

The present invention belongs to the field of oil refining, petrochemical, chemical industry and petroleum product processing equipment, in particular to a nanocrystalline material based on stainless steel surface used in high corrosion industry environment such as oil refining, petrochemical, petroleum processing, chemical processing and so on and preparation method thereof.

BACKGROUND ART

Austenite stainless steels and ferritic stainless steels are the most widely used stainless steels. However, in the fields of petroleum, chemical industry, pharmaceutical, seawater and others, especially in an environment containing chloride ions and sulfides, low-grade stainless steels such as 304 and 316L shows obvious disadvantages of non-resistance to pitting. The price of high-grade stainless steel such as 317L and AL-6XN are relatively high. In addition, in the comprehensive corrosion environment containing sulfide, chloride, fluoride and high temperature environment, such as refining industry, the higher the content of sulfur and acid of crude oil is, the severer the corrosion of the inner parts of the tower is, therefore, the materials such as 304, 316L can not be used. While the 317L material can only be used for one production cycle in parts of vacuum towers and need to be placed continuously, and the price of the AL-6XN is too expensive.

In this case, the problem to be solved urgently is how to use low-cost and low-grade ferritic stainless steel while ensure one-cycle period. The research on anti-corrosion nanomaterial of stainless steel surface in the refining and chemical industries has great significance At present, the main anti-corrosion methods for stainless steels are to apply new film materials on stainless steel surface for different application environments, including: 1. applying coating, ion, plasma special materials; 2. acid-washing to form an oxide film; 3. surface treating to form special materials.

Coating refers to applying or spraying a material directly onto surfaces of substrates. Chinese patent application nos. CN201510141891.7, CN200980103178.6 and CN201310714835.9 disclose coating Ni, W or metal oxide and organic polymer material. Plating refers to forming a layer of material on stainless steel surface gradually by means of plating (such as electroplating, ion plating, sputtering, etc.). Chinese patent application nos. CN201310533567.0, CN201210208577.2 and CN101187044 A disclose plating a layer of inert metal and composite material on the surface of stainless steel to increase corrosion resistance. However, there will be an obvious interface between coating/plating layer and stainless steel substrate, and because of inconsistent thermal expansions between coating/plating layer and stainless steel substrate, the layer will peel off in practical applications and lead to a weaken anti corrosion effect. Furthermore, coating could not be applied in internal parts of complex equipment, thus its use is subject to certain restrictions.

Acid-washing and passivating is to form a passivation film by immersing directly by use of a chemical solution. Chinese patent application no. CN201310714835.9 discloses that an oxidation film on surface can be used to improve the anti-corrosion effect. However, the use of ultrasonic cleaning limits the cleaning of large equipment, and the surface pitting resistance index after acid-washing and passivating only has a limited increase, furthermore, the thickness of the passivation film is generally less than 20 nm, therefore the anti-corrosion effect is not obvious.

Metal surface treatment is to form specific film layer on surface of stainless steel by chemical or electrochemical method. Chinese patent application no. CN103074634 A discloses that the anti-corrosion effect can be improved by preparing film layer having a unique crystal structure on stainless steel surface. However, the pre-treatment and post-treatment of metal surface is complicated, and some surface pre-treatment need to polish the stainless steel surface while the pre-treatment need to be processed at temperature of 100-500° C. for 1-3 hours, which causes it is hard to use in practical industry and hard to be industrialized.

Others process such as vacuum vapor deposition have better anti-corrosion effect and strong bonding force between surface material and stainless steel substrate, but the vacuum processing limits it should be used for large stainless steel equipment and at present it is only used for treating small items such as screws, nuts, etc.

SUMMARY OF THE INVENTION

The object of the present invention is to provide a nanocrystalline material based on stainless steel surface, which can be applied to various types of stainless steel substrates. The maximum pitting resistance equivalent Pren value of the nanocrystalline material is between 40 and 58, which is increased by 1.5 to 2.3 times. The anti-corrosion effect of the new nanocrystalline layer material against chloride ions, sulfides, organic acids, etc. is significantly higher than that of ordinary stainless steel 304, 316L, and 317L without nanocrystalline layers, which is equivalent to the corrosion resistance of AL-6XN and 904L alloys. In addition, the total thickness of the nanocrystalline material of the present invention is 700-900 nm, and the surface of the material is inlaid with the substrate, their coefficients of thermal expansion are equivalent, there is no obvious bonding interface, therefore they will not fall off from the substrate in a high temperature medium for a long time. The pre-treatment and post-treatment of nanocrystalline materials are carried out under normal temperature and normal pressure, and are easy to be industrialized and applied to large-scale stainless steel equipment.

The technical solution for achieving the above object is as follows:

The present invention provides a nanocrystalline material based on stainless steel surface, comprising, expressed in percentage by weight, 0-3% of carbon, 20-35% of oxygen, 40-53% of chromium, 10-35% of iron, 1-4% of molybdenum, 1-4% of nickel, 0-2.5% of silicon, 0-2% of calcium and with the balance being impurity elements.

Preferably, the amount of the impurity elements is <1%;

Preferably, the nanocrystalline material comprises, expressed in percentage by weight, 0.83% of carbon, 32.18% of oxygen, 44.28% of chromium, 14.47% of iron, 1.0% of molybdenum, 3.06% of nickel, 2.43% of silicon, 1.11% of calcium with the balance being impurity elements;

Preferably, the friction coefficient g of nanocrystalline material is 0.07-0.098, preferably 0.092.

The present invention also provides a method for preparing the nanocrystalline material based on stainless steel surface, comprising the following steps:

(1) chemically degreasing and etching with alkali a stainless steel surface using a sodium hydroxide solution and a solution containing an alkali etching active agent, followed by washing with water;

(2) oxidizing the stainless steel surface treated in the step (1) by an oxidizing solution, followed by washing with water;

(3) immersing the stainless steel surface treated in the step (2) as a cathode in an electrolyte to electrolyze, followed by washing with water;

(4) placing the stainless steel surface treated in the step (3) at a temperature of 50-60° C. and a humidity of 60-70% for hardening.

Preferably, in the step (1), the temperature of the sodium hydroxide solution and the solution containing the alkali etching active agent is 80-85° C.

Preferably, the concentration of the sodium hydroxide solution is 6.5-8%.

Preferably, the concentration of the solution containing alkali etching active agent is 0.3-0.5%.

Preferably, the alkali etching active agent is ethoxylated polytrisiloxane.

Preferably, the chemically degreasing and etching with alkali is carried out for 10-15 minutes.

Preferably, the washing with water is performed by using water with a temperature of 80-85° C. for 3-5 minutes.

Preferably, in the step (2), the oxidizing solution contains 200-300 g/L of $CrO_3$ and 100-150 g/L of $Na_2MoO_4$.

Preferably, the temperature of the oxidizing solution is 75-90° C.

Preferably, the pH of the oxidizing solution is 0.4-1.5; preferably, the pH of the oxidizing solution is adjusted to 0.4-1.5 by adding a $H_2SO_4$ solution into the oxidizing solution; preferably, the concentration of the $H_2SO_4$ solution is 98%.

Preferably, the time for oxidizing is 15-35 minutes.

Preferably, the washing with water in the step (2) is performed cyclically by using water at 25-40° C. for 3-5 minutes; preferably, the pH of the water is >3.

Preferably, in the step (3), the electrolyte contains 100-150 g/L of $CrO_3$, 100-150 g/L of $Na_2MoO_4$, 200-250 g/L of $H_3PO_4$, 50-60 g/L of $Na_2SiO_3$.

Preferably, the temperature of the electrolyte is 40-52° C.

Preferably, the pH of the electrolyte is 0.5-1.5; preferably, the pH of the electrolyte is adjusted to 0.5-1.5 by adding a $H_2SO_4$ solution into the electrolyte; preferably, the concentration of the $H_2SO_4$ solution is 98%.

Preferably, the current for electrolyzing is direct current; preferably, the intensity of the current is 42-5 $A/m^2$; preferably, the initial current intensity is 40 $A/m^2$, and then the current intensity is gradually reduced to 5 $A/m^2$ according to the formula $i=3+A/t$, wherein i is current intensity, t is time, and A is parameter of 20-30. Preferably, the time for electrolyzing is 25-55 minutes.

Preferably, the electrolysis comprises electrolyzing for 10-25 minutes at an initial current intensity of 40 $A/m^2$, and then gradually reducing the current intensity to 5 A/m2 during 15-30 minutes while electrolysis.

Preferably, the washing with water is performed cyclically by using water at 25-40° C. for 3-5 minutes; preferably, the pH of the water is >3.

Preferably, in the step (4), the performed time for hardening treatment is 3-4 hours.

The invention also provides a nanocrystalline material based on stainless steel surface prepared according to the method of the present invention.

The invention further provides a stainless steel substrate containing the nanocrystalline material prepared according to the method of the present invention.

To explain the objects, the technical features and the beneficial effects of the present invention more in detail, the nanocrystalline materials of the present invention will be further described in combined with the 304 stainless steels.

As shown in FIG. 1, after being treated with the nanocrystalline material of the present invention, the 304 stainless steel substrate shows a dark color, which has great difference compared with the color of the untreated 304 stainless steel substrate (the left side of FIG. 1 is 304 stainless steel substrate, the right side of FIG. 1 is the 304 stainless steel substrate treated by the nanocrystalline material according to the present invention). The nanocrystalline material is observed by a metallographic microscope, and it is found that the nanocrystalline material has covered the surface intergranular of the original 304 stainless steel, which lead to prominent intergranular corrosion resistance, as shown in FIG. 2.

It can be seen that, in the prepared nanocrystalline material based on 304 stainless steel substrates according to the method of the present invention, the nanocrystalline material formed on the 304 stainless steel surface is combined with the 304 stainless steel substrate in an inlaid manner. The 304 stainless steel substrate material forms a honeycomb substrate structure on the surface the shallower to the deeper, and voids of the honeycomb substrate structure are filled with a hardened nanocrystalline material. Since there is no combining interface between the stainless steel substrate and the nanocrystalline material, the thermal expansion of the nanocrystalline material and the stainless steel substrate will not lead to obvious fault layers. When the temperature of the contacting medium fluctuates significantly, such inlaid manner will keep the film layer between the nanocrystalline material and the stainless steel substrate from falling off. The adhesion of the nanocrystalline material is far greater than that of coating and plating materials. As shown in FIG. 3, the blank area is 304 stainless steel substrate, and the nanocrystalline material of the present invention is combined with the substrate by means of being dense in the surface and sparse in inner layer.

The layers of the combined product of the substrate and the nanocrystalline material were analyzed by X-ray photoelectron spectroscopy, and it was found that the layers are, from the outermost surface layer to the innermost layer, a repair and transformation layer, an amphoteric hydroxide layer, an oxide layer and a substrate layer. There is no obvious intersection between the layers. The trend of the specific composition and the depth is shown in FIG. 4, wherein, the thickness of the repair and transformation layer is 1-100 nm, this layer is mainly characterized in that the anti-pitting corrosion of the transformation layer contains Mo element, in the repair layer, trivalent chromium is the surface crystalline skeleton while hexavalent chromium is the filler, and both maintain the stability of the layer elements and increase the corrosion resistance together. The thickness of the amphoteric hydroxide layer is 200-500 nm, this layer is mainly composed of chromium oxide and chromium hydroxide layer. The thickness of the oxide layer is 500-900 nm, this layer is mainly composed of chromium oxide and chromium elementary layer, while the content of the iron elementary layer in this layer is rapidly increased to the content which is equivalent to that of the substrate. The thickness of substrate layer is >900 nm, this layer is the normal composition of the 304 stainless steel substrate. As can be seen from FIG. 2, there is no obvious interface between the substrate layer and the three layers on the surface of the nanocrystalline material, and the binding strength is strong.

The test of the binding ability between the nanocrystalline material according to the present invention and the stainless steel substrate is carried out as follows: the testing sheet including the stainless steel-based nanocrystalline material of the present invention was heated to a preset high temperature and then placed into a cold water to quench, the test was performed for several times repeatedly to observe the adhesion of the bonding layer between the nanocrystalline material and the stainless steel substrate. The thermal shock test on the testing sheet applying the nanocrystalline materials based on the stainless steel was performed according to the standard of GB/T5270-2005/ISO2819: 1980. The testing temperature was increased successively to 100° C., 300° C., 500° C., 800° C. and 1000° C., the testing sheet did not appear cracks and peeling on the surface. Though the color of the surface was changed a little at high temperature of 800° C. and 1000° C., the composition of the surface of the nanocrystalline materials was maintained unchanged when tested by X-ray photoelectron spectroscopy. When stretched to a deformation of 30% at a high temperature of 1000° C., the nanocrystalline material had the same stretch ratio as the substrate material.

The nanocrystalline material based on the commonly used stainless steel (304, 316L, 317L and 0Cr13) were analyzed by X-ray photoelectron spectroscopy elemental analysis for many times. The composition of the elements was as shown in Table 1:

TABLE 1

Testing result of the nanocrystalline material based on the stainless steel according to the present invention

| Elements | Composition (wt. %) |
|---|---|
| Carbon | 0-3 |
| Oxygen | 20-35 |
| Chromium | 40-53 |
| Iron | 10-35 |
| Molybdenum | 1-4 |
| Nickel | 1-4 |
| Silicon | 0-2.5 |
| Calcium | 0-2 |
| Impurity elements | <1 |

By calculating according to the following pitting resistance equivalent $$\text{Pren}=1\times Cr+3.3\times Mo+20\times N$$

the Pren value of the nanocrystalline material based on the stainless steel 304 of the present invention is improved largely, and is 40-58.

Wherein, the nanocrystalline material based on the stainless steel 304 was analyzed by X-ray photoelectron spectroscopy for many times. The composition of the elements was as shown in Table 2:

TABLE 2

Testing result of the nanocrystalline material based on the stainless steel according to the present invention

| Elements | Composition (wt %) |
|---|---|
| Carbon | 0.83 |
| Oxygen | 32.81 |
| Chromium | 44.28 |
| Iron | 14.47 |
| Molybdenum | 1.0 |
| Nickel | 3.06 |
| Silicon | 2.43 |
| Calcium | 1.11 |

By calculating according to the following pitting resistance equivalent $$\text{Pren}=1\times Cr+3.3\times Mo+20\times N$$

the Pren value of the nanocrystalline material based on the stainless steel 304 of the present invention is 47.58.

Based on different stainless steel substrates, the specific process of the method according to present invention is as follows:

The process route is: chemically degreasing with hot alkaline and etching with alkali; washing with water; oxidizing; washing with water; electrolyzing; washing with water; hardening.

A sodium hydroxide solution and a solution containing an alkali etching active agent are used to chemically degrease and etch a stainless steel surface, and then water is used to wash; wherein the temperature of the solution are controlled at 80-85° C., the treatment is performed for 10-15 min. Hot water with a temperature of 80-85° C. is used for washing for 3-5 min; wherein the amount of the sodium hydroxide solution and the solution containing the alkali etching active agent is subjected to immerse the whole stainless steel surface.

The composition of the oxidizing solution contains 200-300 g/L of $CrO_3$ and 100-150 g/L of $Na_2MoO_4$. At temperature of 75-90° C., the pH of the solution is adjusted to 0.4-1.5 by adding a 98% $H_2SO_4$ solution. The time for oxidizing is 15-35 min; and then the oxidizing solution is washed.

The composition of the electrolyte contains 100-150 g/L of $CrO_3$, 100-150 g/L of $Na_2MoO_4$, 200-250 g/L of $H_3PO_4$, 50-60 g/L of $Na_2SiO_3$. The pH of the electrolyte is adjusted to 0.5-1.5 by adding a 98% $H_2SO_4$ solution, the temperature is controlled at 40-52° C. The stainless steel piece is taken as cathode. The initial current intensity is 40 A/m$^2$, and the electrolysis is performed for 10-25 min, and then the current intensity is gradually reduced, the electrolysis is performed for 15-30 min in such gradually reduced manner. In the electrolysis step, the current is direct current, the initial current intensity is 40 A/m$^2$, and then the current intensity is gradually reduced according to the formula $i=3+A/t$, wherein i is current intensity, t is time and A is parameter of 20-30. After electrolyzing, the electrolyte on surface is washed by water.

The washed film layer is hardened at a temperature of 50-60° C. and a humidity of 60-70% for 3-4 hours, the treatment is finally completed.

The pitting effect of the nanocrystalline material based on stainless steel according to the present invention is very obvious, and the pitting resistance equivalent Pren is 40-58, which is higher than many excellent stainless steel alloy materials. There is no obvious combining interface between the nanocrystalline material based on stainless steel and the stainless steel substrate, and the nanocrystalline material combine with the stainless steel substrate in an inlaid manner, therefore, there is no obvious fault. The main principle is to fill the metal and metal oxide crystalline of the nanocrystalline material layer in the honeycomb structure by oxidizing process. A honeycomb microporous structure is formed on the stainless steel surface by oxidizing process, the microporous structure is filled with metal and metal oxide crystalline of the nanocrystalline material by electrolyzing, and then the nanocrystalline material is combined with the substrate by hardening process.

In the present invention, the control of the current intensity during electrolyzing is important. Short time and large current will lead to insufficient chromium and silicon elements in the honeycomb hole of the stainless steel surface, thereby leading to holes in the middle layer, insufficient density and deteriorated corrosion resistance. Therefore, the current intensity, the time and temperature for electrolyzing and the current intensity which decreases in the later stage of electrolysis will affect the atomic packing factor of the nanocrystalline material.

The temperature and humidity for hardening in the present invention is very important. When the temperature is too high, the film will age and crack. When the temperature is too low, the film will be soft and the filled metal and metal oxide crystalline are easy to fall off from the substrate during the rinsing and friction process.

BRIEF DESCRIPTION OF THE DRAWINGS

Hereinafter, exemplary embodiments of the present invention will be described in detail with reference to the accompanying drawings, wherein.

DESCRIPTION OF THE PREFERRED EMBODIMENTS

Further described the present invention in detail in conjunction with specific embodiments below, the examples are given only for illustrating the present invention and are not intended to limit the scope of the invention.

The experimental methods in the following examples are conventional methods unless otherwise specified. The raw materials, reagent materials, etc., in the following examples are commercially available products unless otherwise specified.

Example 1: The Test on Current Control of the Method According to the Present Invention In the method of the present invention, the change in current during electrolysis has a large influence on the atomic packing factor of the nanocrystalline material surface. It can be found from the standard ferric chloride corrosion test that the atomic packing factor of the nanocrystalline material surface has a great influence on the corrosion results. The change in the coefficient of friction (according to GB/T12444-2006 test standard, with a silicon carbide ball of Φ6, with a loading force of 200 g, a rotating speed of 120 rpm, for 3 min) and the change in the corrosion resistance of the nanocrystalline material surface were observed by various changes in the electrolysis current, and the results shown that the smaller the coefficient of friction was, the better the corrosion resistance was.

Figure 15:
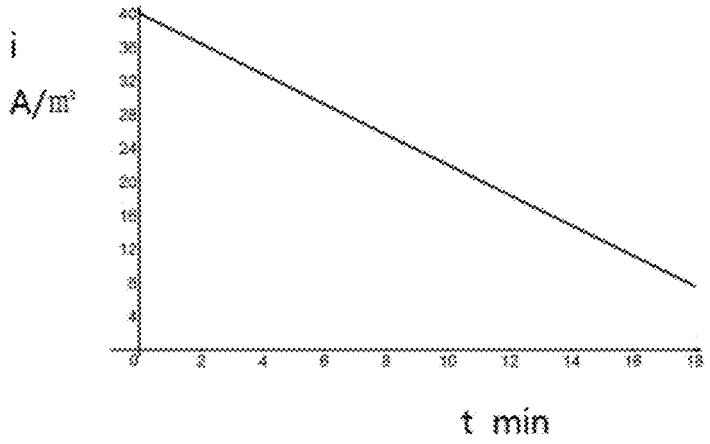
FIG. 15: a current-time profile according to the formula $i=40-2.33t$ (wherein, i is current intensity, t is dense duration time (min)) after electrolyzing for 15 min.
Figure 16:
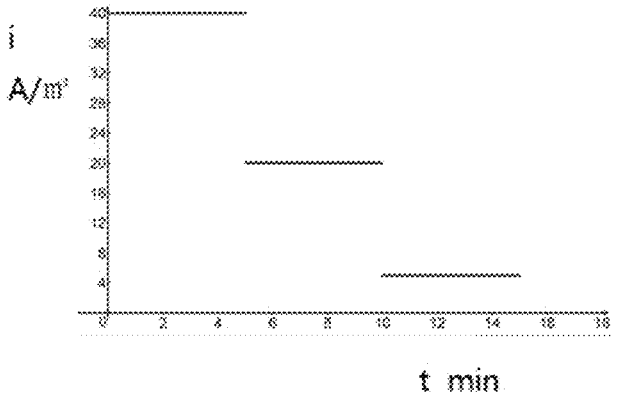
FIG. 16: a current-time profile after electrolyzing for 15 min, wherein at 0-5 min, the current is 40 $A/m^2$; at 5-10 min, the current is 20 $A/m^2$; at 10-15 min, the current is 15 $A/m^2$.
Figure 17:
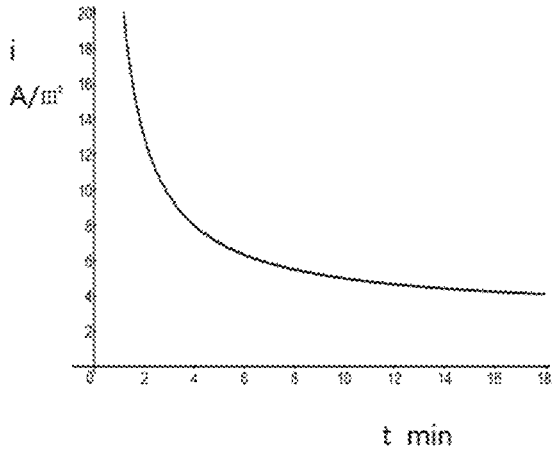
FIG. 17: a current-time profile according to the formula $i=3+30/t$ (wherein, i is current intensity, t is dense duration time (min)) after electrolyzing for 15 min.

As shown in FIGS. 15-17, X axis (horizontal axis) is time (min), Y axis (longitudinal axis) is current intensity ($A/m^2$);

Scheme 1: As shown in FIG. 15, the current intensity was i=40-2.33t (i is current intensity, t is duration time);

Scheme 2: As shown in FIG. 16, the current intensity was: at 0-5 min, the current was 40 $A/m^2$; at 5-10 min, the current was 20 $A/m^2$; at 10-15 min, the current was 5 $A/m^2$;

Scheme 3 (the current was controlled according to the method of the present invention): As shown in FIG. 17, the current intensity of the method according to the present invention is: i=3+A/t (i is current intensity $A/m^2$, t is duration time, A (parameter) is 20-30);

The results were shown in Tables 3 and 4:

TABLE 3 friction coefficients and corrosion rate of the nanocrystalline material based on 304 stainless steel substrate (2B cold rolled stainless steel - NO. 1)

| Schemes | Friction coefficient μ (being tested according to GB/T12444-2006 standard) | Corrosion rate of standard ferric chloride $g/m^2h$ |
|---|---|---|
| 304 stainless steel substrate (without the nanocrystalline material) | 0.131-0.155 | 17.68-22.05 |
| Scheme 1 | 0.997-0.105 | 2.01-2.32 |
| Scheme 2 | 0.108-125 | 4.36-5.02 |
| Scheme 3 (the current was controlled according to the method of the present invention) | 0.086-0.092 | 0.91-1.12 |

Conclusion: Different ways of changing the current lead to different atomic packing factor of stainless steel nano-surfaces. As can be seen from the Table 3, the smaller the friction coefficient gi was, the smoother the nano-surface film layer was, and the higher the atomic packing factor of the nano-crystal surface was, his will result in good corrosion resistance.

According to the test of changing the current, it was found that when the change of current was subjected to the hyperbolic function i=3+A/t (i is current intensity $A/m^2$, t is duration time, A (parameter) is 20-30), the atomic packing factor of the nanocrystalline materials surface was the highest. Thus, the friction coefficients of various materials in which the change of current was subjected to the hyperbolic function were tested. The result was shown in Table 4.

TABLE 4 friction coefficients of the nanocrystalline material based on different various stainless steel substrates (2B cold rolled stainless steel - NO. 1) Materials (2B cold rolled stainless steel - NO. 1), the initial current was 40 $A/m^2$, the current intensity was subjected to i = 3 + A/t (i is current intensity $A/m^2$, t is duration time, A (parameter) is 20-30), the friction coefficients μ(was tested according to the GB/T12444-2006 standard)

| Materials | Friction coefficients μ | Materials of nanosurface | Friction coefficients μ | Average reduction percentage % |
|---|---|---|---|---|
| 304 | 0.131-0.155 | 304 nanosurface | 0.086-0.092 | 37.76% |
| 304Ti | 0.133-0.158 | 304Ti nanosurface | 0.086-0.095 | 37.80% |
| 316L | 0.115-0.137 | 316L nanosurface | 0.078-0.086 | 34.92% |
| 317L | 0.095-0.115 | 317L nanosurface | 0.07-0.079 | 29.05% |
| 410S | 0.142-0.168 | 410S nanosurface | 0.092-0.102 | 37.42% |
| 2205 | 0.108-0.129 | 2205 nanosurface | 0.073-0.085 | 33.33% |
| 201 | 0.138-0.162 | 201 nanosurface | 0.091-0.098 | 37.00% |

Conclusion: The most common available stainless steel 2B cold rolled stainless steel—NO. 1 was tested, and the change of current was subjected to the hyperbolic function, the atomic packing factor was the highest, the friction coefficient was the least, when compared with other various stainless steel substrates, the friction coefficient of the nanocrystalline surface is reduced by 29-38%.

Example 2: Surface Hardening Test of the Nanocrystalline Material According to the Present Invention The hardening on the nanocrystalline material based on the stainless steel surface has a great influence on the corrosion resistance. At present, the hardening of the stainless steel surface is usually dried at room temperature.

In the present invention, the inventors evaluated the corrosion resistance of the nanocrystalline material surface using anti-flowing corrosion effect under different temperature, humidity and time to screen the most suitable surface hardening conditions.

Figure 18:
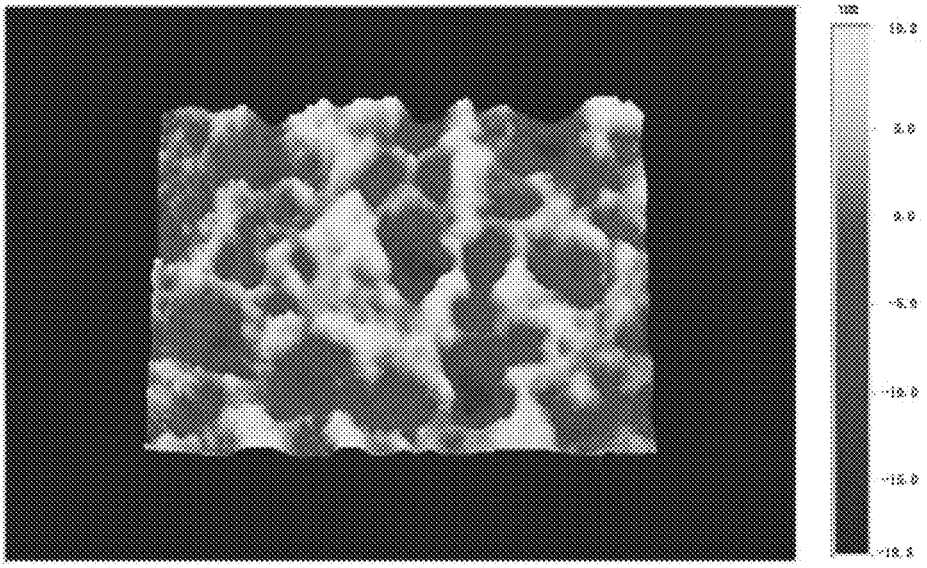
FIG. 18: a surface depth chart of 3D optical profiler of the nanocrystalline layer based on 304 substrate (2B cold rolled stainless steel—NO. 1) hardened at a temperature of 60° C.
Figure 19:
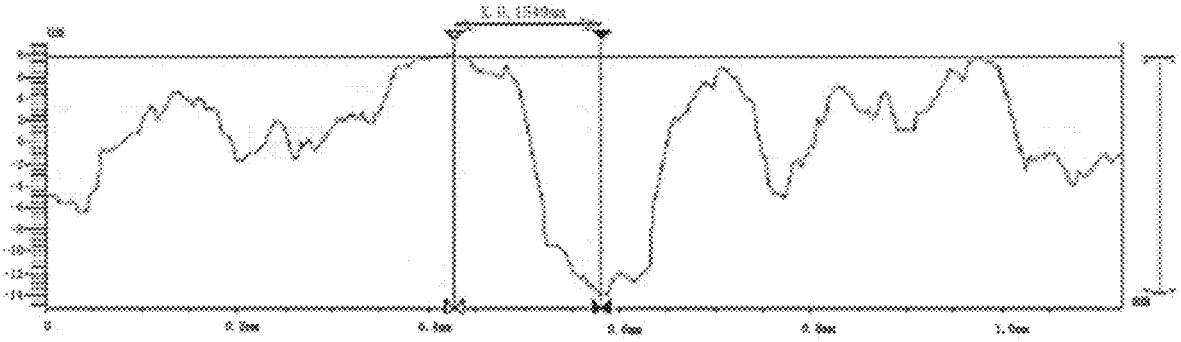
FIG. 19: a surface depth measurement chart of 3D optical profiler of nanocrystalline layer based on 304 substrate (2B Cold rolled stainless steel—NO. 1) hardened at a temperature of 60° C.

The effect of the hardening temperature on the nano surface was tested by a 3D optical profilometer. According to the ASME B46.1-2009 standard, the roughness depth of the nanocrystalline surface was tested at a temperature of 20±3° C. and a relative humidity of 40-80%, the vibration velocity of air-floating seismic isolation system was <2.28 μm/s, the air pressure was 0.275-0.55 Mpa, the voice was <60 dB-A, the voltage was 85-264 VAC and 47-63 Hz. The testing results of more than 20 the deepest points on the hardened surface were taken to calculate the average roughness depth. The testing results were shown in FIGS. 18-19 and Table 4.

Meanwhile, the standard ferric chloride corrosion test on the nanocrystalline surface was carried out under constant temperature and humidity conditions in a flowing corrosive environment. The corrosion resistance environment of the nanocrystalline material surface based on 304 substrate (2B cold rolled stainless steel—NO. 1) was shown in Tables 5-7. It can be seen from the FIGS. 20-21 that the hardening temperature had significant effect on the uniformity of the surface layer of the formed nanocrystalline material.

TABLE 5

Effect of hardening temperature on the resistance of the nanocrystalline material surface to corrosion
Effect of hardening temperature on corrosion resistance of the nanocrystalline material surface (the humidity was controlled at 60%, the hardening time was 4 h)

| Nos. | Hardening temperature ° C. | Surface average roughness depth (um) | Corrosion rate of flowing (with a flow rate of 1 m/s) ferric chloride g/m$^2$h |
|---|---|---|---|
| 1 | Room Temperature-Uncertain Humidity | 22.2522-25.7840 | 8.68-2.35 |
| 2 | 30 | 19.9217 | 4.09 |
| 3 | 40 | 17.1534 | 2.87 |
| 4 | 50 | 11.9166 | 1.55 |
| 5 | 60 | 15.6419 | 2.41 |
| 6 | 70 | 28.9225 | 6.22 |
| 7 | 80 | 67.7151 | 10.84 |

It can be seen from Table 5 and FIGS. 18-21, the hardening temperature has an effect on the softness/hardness of the nano-film layer. When the hardening temperature was low, the nano-film layer was easy to fall off, when the hardening temperature was high, the surface of the nano-film layer had crack. It can be seen from the surface average roughness depths, when the hardening temperature rose, the crack appeared on the surface, which led to rapid increase of the surface roughness depths. It can be seen from the results of the flowing ferric chloride corrosion test, when the hardening temperature rose, the corrosion rate of flowing ferric chloride increased, which led to the decrease of corrosion resistance to liquid. In the present invention, the hardening temperature can greatly improve the corrosion resistance to liquid, and the best hardening temperature was 50-60° C., meanwhile such temperature can control the surface roughness depth at 10-20 um.

TABLE 6

Effect of hardening humidity on the resistance of the nanocrystalline material surface to corrosion
Effect of hardening humidity on the resistance of the nanocrystalline material surface to corrosion (the temperature was controlled at 50° C., the hardening time was 4 h)

| Nos. | Hardening Humidity % | Corrosion rate of flowing (with a flow rate of 1 m/s) ferric chloride g/m$^2$h |
|---|---|---|
| 1 | <2 | 11.27 |
| 2 | 20 | 6.58 |
| 3 | 30 | 4.61 |
| 4 | 40 | 2.23 |
| 5 | 50 | 1.78 |
| 6 | 60 | 1.55 |
| 7 | 70 | 1.62 |
| 8 | 80 | 1.76 |
| 9 | 95 | 1.82 |

Conclusion: the effect of hardening humidity on the softness/hardness of the nano-film layer was similar to that of the hardening temperature. The hardening humidity was low, the surface of the nano-film layer had cracks, the humidity was high, the nano-film layer was soft and easy to fall off. It can be seen from the corrosion results of the flowing ferric chloride that, in present invention, the suitable hardening humidity can improve the corrosion resistance to liquid. The suitable humidity was 60~70%.

TABLE 7

Effect of hardening time on the resistance of the nanocrystalline material surface to corrosion
Effect of hardening time on the resistance of the nanocrystalline material surface to corrosion (the temperature was controlled at 50° C., the humidity was 60%)

| Nos. | Hardening time h | Corrosion rate of flowing (Flow rate 1 m/s) ferric chloride g/m$^2$h |
|---|---|---|
| 1 | 0.5 | 3.51 |
| 2 | 1 | 2.42 |
| 3 | 2 | 1.88 |
| 4 | 3 | 1.56 |
| 5 | 4 | 1.55 |
| 6 | 6 | 1.53 |
| 7 | 12 | 1.49 |
| 8 | 24 | 1.45 |

Conclusion: It can be seen from the table 7, the longer the hardening time was, the better the effect was. The longer the time was, the higher the stability of the nano-film layer was. However, considering the processing time, in the present invention, the best time was 3-4 h.

Example 3: Ni Element Content Test on the Nanocrystalline Material Surface According to the Present Invention Ni is an important auxiliary element in austenitic stainless steel, which can stabilize the structure of austenitic stainless steel and enhance the corrosion resistance and toughness of weld metals. Its general content is 7-12%. When the Ni content is less than 7%, the toughness of the austenitic stainless steel is insufficient, and when the Ni content is >12%, the strength of the austenitic stainless steel is decreased. In the present invention, the inventors have performed a large number of tests, controlled the Ni content in the surface layer (i.e., the repair conversion layer) of the nanocrystalline material by adjusting the oxidation time, pH value, electrolysis time, pH value, the concentration of the electrolyte, and formulation, etc.

In particular, the inventors performed the following tests to test the anticorrosion effect of the nanocrystalline material surface containing different content of Ni, thereby screening the best Ni content: the standard ferric chloride corrosion test (according to the GB/T17897-1999 standard, the temperature was 50° C.), 1 m/s mobile chloride ion corrosion test (the corrosion solution was formulated according to the GB/T17897-1999 standard, the testing time was 24 h, the flow rate of the corrosion solution in the test pipe was controlled at 1 m/s by using a flow pump, the testing sample was placed along the flowing direction of the corrosion solution, the testing temperature was 35° C., the corrosion effect of the flowing corrosive medium on the nanocrystalline layer surface was observed), 10% hydrochloric acid corrosion test (according to the GB/T17897-1999 standard, 10% hydrochloric acid solution was formulated, the testing temperature was 50° C.), 1.5 m/s flowing hydrochloric acid corrosion test (according to GB/T17897-1999 standard, 10% hydrochloric acid corrosion solution was formulated, the time was 24 h, the flow rate of the corrosion solution in the test pipe was controlled at 1 m/s by using a flow pump, the testing sample was placed along the flowing direction of the corrosion solution, the testing temperature was 35° C., the corrosion effect of the flowing corrosive medium on the nanocrystalline layer surface was observed) and nanoindentation hardness test (according to the GB/T21838.1-2008 standard of).

304 substrate was taken as an example, the content of Ni in the 304 substrate was 8%, when the Ni content in surface nanolayer was <7%, the Ni element in the substrate can be used directly; when the Ni content was >7%, the Ni element needs to be supplemented by adding additional nickel sulfate into electrolyte, the Ni content of the nanolayer can be controlled by adjusting the concentration.

1. The standard ferric chloride corrosion test was carried out in a constant temperature, static and corrosive environment, and the corrosive environment of the surface of the nanocrystalline material based on the 304 substrate was shown in Table 8.

TABLE 8

Effect of Ni content in the nanocrystalline surface based on 304 substrate on the resistance to corrosion
Effect of Ni content in the nanocrystalline surface based on 304 substrate on the resistance to corrosion (the oxidizing time was 20 min, the hardening time was 4 hours, the nano Ni content was controlled by controlling the electrolysis time and concentration)

| Nos. | Ni content in the nanocrystalline layer (11 nm layers was detected by XPS) | Corrosion rate of standard ferric chloride g/m$^2$h (according to GB/T17897-1999 standard, the testing temperature was 50° C.) |
|---|---|---|
| 1 | 0 | 1.02 |
| 2 | 0.02 | 0.91 |
| 3 | 0.51 | 0.87 |
| 4 | 1.2 | 0.83 |
| 5 | 2.35 | 0.81 |
| 6 | 3.57 | 0.80 |
| 7 | 5.74 | 0.83 |
| 8 | 6.48 | 0.85 |
| 9 | 7.25 | 0.87 |
| 10 | 9.21 | 0.95 |
| 11 | 10.53 | 1.15 |

2. 10% hydrochloric acid corrosion test was carried out in a constant temperature, static and corrosive environment, and the corrosive environment of the surface of the nanocrystalline material based on the 304 substrate was shown in Table 9.

TABLE 9

Effect of Ni content in the nanocrystalline surface based on 304 substrate on the resistance to corrosion
Effect of Ni content in the nanocrystalline surface based on 304 substrate on the resistance to corrosion (the oxidizing time was 20 min, the hardening time was 4 hours, the nano Ni content was controlled by controlling the electrolysis time and concentration)

| Nos. | Ni content in the nanocrystalline layer (11 nm layers was detected by XPS) | Corrosion rate of 10% hydrochloric acid g/m$^2$h (the testing temperature was 50° C.) |
|---|---|---|
| 1 | 0 | 1.74 |
| 2 | 0.01 | 1.66 |
| 3 | 0.52 | 1.57 |
| 4 | 1.51 | 1.21 |
| 5 | 2.61 | 1.12 |
| 6 | 3.41 | 1.05 |
| 7 | 5.74 | 1.01 |
| 8 | 6.81 | 1.13 |
| 9 | 7.42 | 1.22 |
| 10 | 8.94 | 1.35 |
| 11 | 11.05 | 1.54 |

Conclusion: For the static and corrosive environment, when the corrosion was made by ferric chloride and hydrochloric acid, the Ni content in the surface of the nanocrystalline layer has no obvious effect on the corrosion, but the result shows that the optimal Ni content range is 2-5%.

3. The ferric chloride corrosion test under flowing environment was carried out in a constant temperature, flowing and corrosive environment to simulate the erosion corrosion environment in industrial devices, and the corrosive environment of the surface of the nanocrystalline material based on the 304 substrate was shown in Table 10.

TABLE 10

Effect of Ni content in the nanocrystalline surface based on 304 substrate on the resistance to erosion and corrosion
Effect of Ni content in the nanocrystalline surface based on 304 substrate on the resistance to corrosion (the oxidizing time was 20 min, the hardening time was 4 hours, the nano Ni content was controlled by controlling the electrolysis time and concentration)

| Nos. | Ni content in the nanocrystalline layer (11 nm layers was detected by XPS) | Corrosion rate of flowing (with a flow rate of 1 m/s) ferric chloride g/m$^2$h |
|---|---|---|
| 1 | 0 | 3.52 |
| 2 | 0.01 | 2.23 |
| 3 | 0.47 | 1.88 |
| 4 | 1.1 | 1.62 |
| 5 | 2.24 | 1.58 |
| 6 | 3.51 | 1.52 |
| 7 | 5.51 | 2.24 |
| 8 | 6.87 | 4.35 |
| 9 | 7.51 | 7.88 |
| 10 | 9.88 | 12.66 |
| 11 | 11.23 | 18.53 |

4. A double test of hydrochloric acid erosion corrosion under flowing environment was carried out in a constant temperature, flowing and corrosive environment to simulate the erosion corrosion environment in industrial devices, and the corrosive environment of the surface of the nanocrystalline material based on the 304 substrate was shown in Table 11.

TABLE 11

Effect of Ni content in the nanocrystalline surface based on 304 substrate on the resistance to erosion and corrosion
Effect of Ni content in the nanocrystalline surface based on 304 substrate on the resistance to corrosion (the oxidizing time was 20 min, the hardening time was 4 hours, the nano Ni content was controlled by controlling the electrolysis time and concentration)

| Nos. | Ni content in the nanocrystalline layer (11 nm layers was detected by XPS) | Corrosion rate of 10% flowing (with a flow rate of 1.5 m/s) hydrochloric acid g/m$^2$h |
|---|---|---|
| 1 | 0 | 6.02 |
| 2 | 0.01 | 5.88 |
| 3 | 0.49 | 2.51 |
| 4 | 1.21 | 1.94 |
| 5 | 2.58 | 1.82 |
| 6 | 3.78 | 2.02 |
| 7 | 5.46 | 4.52 |
| 8 | 6.51 | 6.87 |
| 9 | 7.89 | 9.51 |
| 10 | 9.81 | 15.78 |
| 11 | 11.55 | 22.31 |

Conclusion: For industrially similar flowing corrosive environments, the corrosion of ferric chloride and hydrochloric acid was taken, and the Ni content in the surface of the nanocrystalline layer has a significant effect on the corrosion, and the added Ni content is significantly different from the inherent Ni content of the substrate, which has an influence on the strength of the skeleton of the nanocrystalline layer. At the same time, the increase of the added Ni content leads to a decrease of anti-corrosion of Cr correspondingly, therefore a high content of Ni may cause a decrease in the corrosion resistance effect. Through the tests of flowing corrosion resistant environment with different content of Ni, the Ni content of the nanocrystalline layer in the present invention is 1-4%.

5. The change of the Ni content in the surface of the nanocrystalline layer also lead to a change in hardness of the surface. Theoretically, the harder the hardness of the surface was, the stronger the erosion resistance was. The corrosive environment of the surface of the nanocrystalline material based on the 304 substrate was shown in Table 12.

TABLE 12

Effect of Ni content in the nanocrystalline surface based on 304 substrate on the resistance to erosion and corrosion Effect of Ni content in the nanocrystalline surface based on 304 substrate on the resistance to corrosion (the oxidizing time was 20 min, the hardening time was 4 hours, the nano Ni content was controlled by controlling the electrolysis time and concentration)

| Nos. | Ni content in the nanocrystalline layer (11 nm layers was detected by XPS) | Nanoindentation hardness (GPa) |
|---|---|---|
| 1 | 0 | 3.61 |
| 2 | 0.02 | 3.88 |
| 3 | 0.51 | 4.35 |
| 4 | 1.2 | 6.08 |
| 5 | 2.35 | 6.4 |
| 6 | 3.57 | 7.05 |
| 7 | 5.74 | 5.88 |
| 8 | 6.48 | 5.87 |
| 9 | 7.25 | 5.48 |
| 10 | 9.21 | 5.2 |
| 11 | 10.53 | 5.19 |

It can be seen from Table 12 that the test results of nanoindentation hardness are consistent with the erosion resistance of Tables 10-11. The hardness of the nanosurface has positive effect on the erosion corrosion in some extent. From the testing results, it can be seen that the area with a hardest hardness is the area with a best erosion resistance. In the present invention, the optimal Ni content is 1-4%.

6. The effect of Ni content in the nanocrystalline surface based on 304 substrate on the resistance to erosion, corrosion and hardness was shown in FIG. 20.

Figure 20:
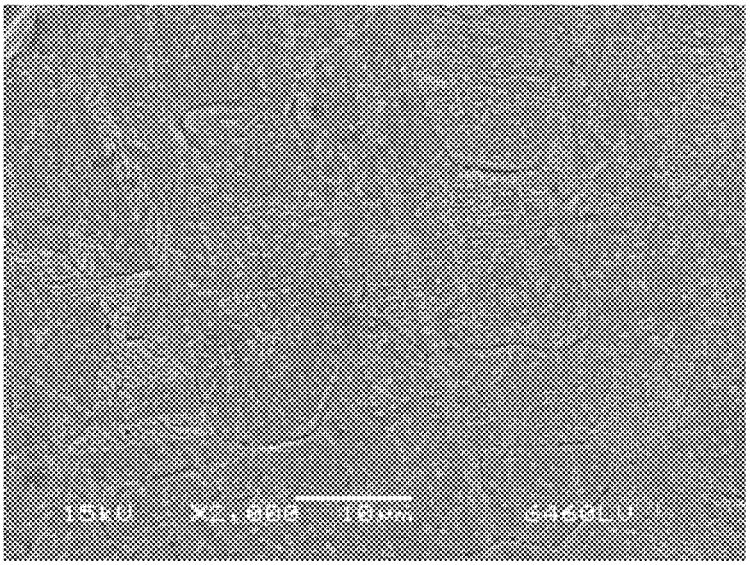
FIG. 20: a electron micrograph diagram of the nanocrystalline layer based on 304 substrate hardened at a temperature of 50° C. and a humidity of 60% for 4 hours.
Figure 21:
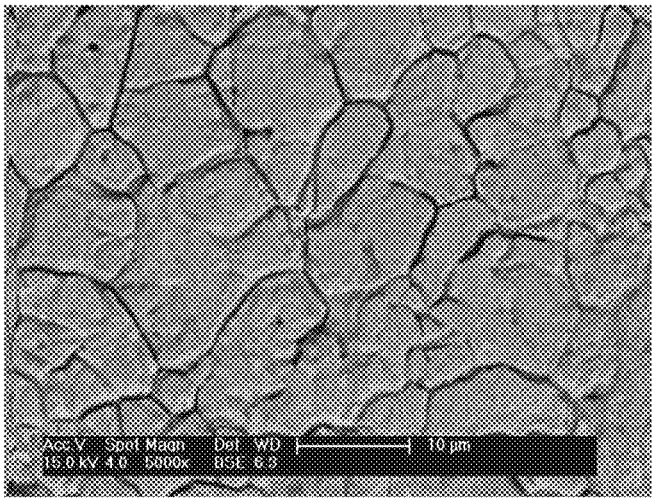
FIG. 21: a electron micrograph diagram of the nanocrystalline layer surface based on 304 substrate hardened at a temperature of 80° C. and a humidity of 60% for 4 hours.
Figure 22:
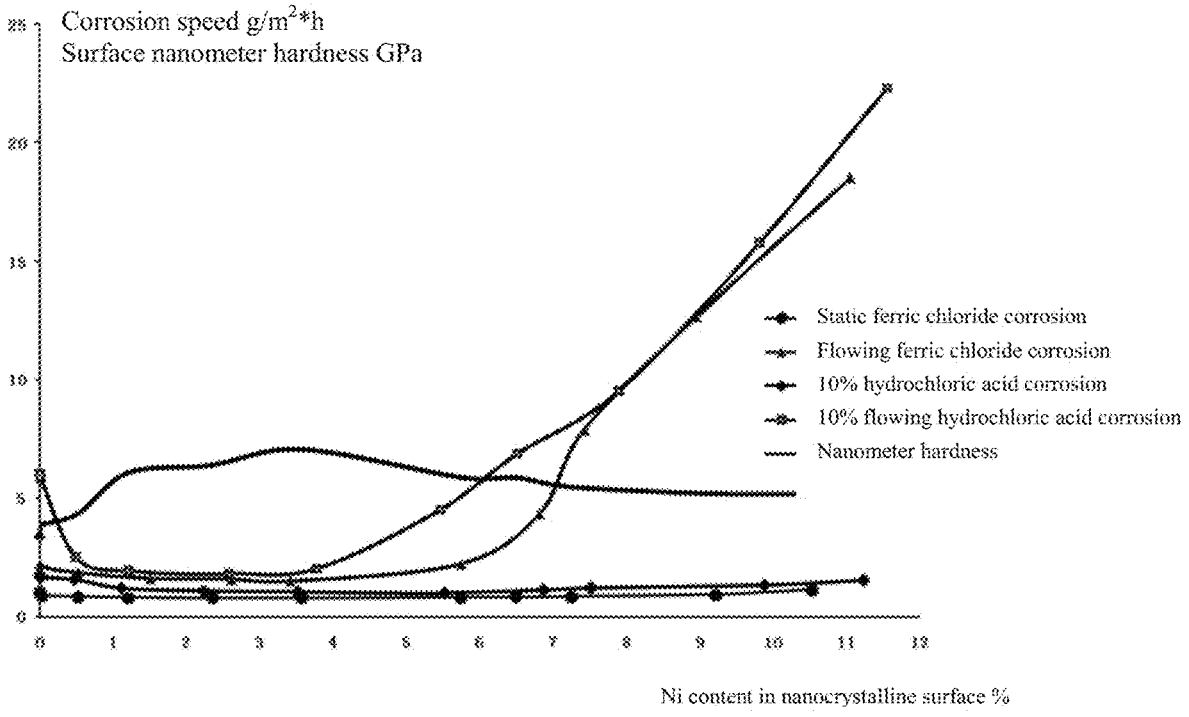
FIG. 22: Ni content of the nanocrystalline material based on stainless steel relative to erosion, corrosion and hardness.

It can be seen from FIG. 20, the testing results of the nanoindentation hardness are consistent with the erosion resistance of Tables 9-10. The hardness of the nanosurface has positive effect on the erosion corrosion in some extent. From the testing results, it can be seen that the area with a hardest hardness is the area with a best erosion resistance. In the present invention, the optimal Ni content is 1-4%.

Example 4: Screening of the Alkali Etching Active Agent According to the Present Invention The cleaning of the surface of stainless steel by chemical degreasing and etching with alkali has influence on the corrosion resistance of the nanocrystalline layer in some extent. The alkali etching active agent was screened in the present invention. 304 substrate was taken as an example, a potential scanning at room temperature was performed on the nanocrystalline materials with different kinds and different amounts of alkali etching active agents, and different self-corrosion potential was obtained. The self-corrosion potential caused by the alkali etching active agent to nanocrystalline material based on 304 substrate is shown in Table 13.

TABLE 13

Self-corrosion potential caused by the alkali etching active agent to nanocrystalline material based on 304 substrate Self-corrosion potential caused by the alkali etching active agent to nanocrystalline material based on 304 substrate (the oxidizing time was 20 min, the electrolysis was performed for 15 + 20 min, the harden time was 4 hours)

| Nos. | Etching active agents (respective optimal ratio wt %) | 3% NaCl self-corrosion potential (with a scanning speed of 1 mV/s, a polarization range of −200 mV~200 mV relative to open circuit potential) |
|---|---|---|
| 1 | Without additives | −0.1354 |
| 2 | HDW-1050(0.3~0.5%) | 0.1127 |
| 3 | Phosphate salt (3~4%) | −0.0347 |
| 4 | Ethoxylated polytrisiloxane (0.3~0.5%) | 0.1868 |
| 5 | Polyethoxylated fatty alcohol (0.7~0.9%) | 0.0794 |
| 6 | OP-10(4~5%) | 0.0255 |
| 7 | PRO22(1.1~1.3%) | −0.1534 |

Conclusion: compared with stainless steels, the self-corrosion potential of the nanocrystalline material based on stainless steels will produce positive shift. The more positive the self-corrosion potential was, the stronger the resistance to electrochemical corrosion was. As for each etching active agents, different ratios of tests with a range of 0.3-5% were performed. Table 12 shows the highest self-corrosion potential after adding each etching active agents in 3% NaCl, as well as the corresponding adding ratios.

It can be seen from Table 13, the best alkali etching active agents in the present invention is ethoxylated polytrisiloxane, and the resistance the nanocrystalline material based on stainless steel to electrochemical corrosion is the best after etching with such alkali with a concentration of 0.3-0.5%.

Example 5: Preparation of the Nanocrystalline Material Based on Stainless Steel (304 Substrate) According to the Present Invention (1) A sodium hydroxide solution with a concentration of 7% and a solution containing 0.5% of ethoxylated polytrisiloxane alkali etching active agent was used to chemically degrease and etch with alkali a stainless steel surface (a 304 substrate). The total amount of the entire solution was subjected to immerse the whole stainless steel surface. The temperature of the solution was controlled at 80° C. The operation was performed for 15 min. After that, water with a temperature of 80° C. was used for washing for 3 min.

(2) The composition of the used oxidizing solution contained 300 g/L of $CrO_3$ and 140 g/L of $Na_2MoO_4$. At 78° C., $H_2SO_4$ solution with a concentration of 98% was used to adjust the pH value to 1.3, the time for oxidizing was 15 min, after that, water under normal temperature was used for washing for 3 min.

(3) The composition of the used electrolytic solution contained 100 g/L of $CrO_3$, 100 g/L of $Na_2MoO_4$, 200 g/L of $H_3PO_4$, 55 g/L of $Na_2SiO_3$. $H_2SO_4$ solution with a concentration of 98% was used to adjust the pH value to 1.3. The temperature was controlled at 40° C. The stainless steel (304 substrate) was used as cathode, based on the surface area of the stainless steel, the electrolysis was performed at the current intensity of 40 A/m$^2$ for 10 min, then was performed at a gradually reduced current intensity according to the formula i=3+30/t (i is current intensity A/m$^2$, t is duration time) for 15 min, and then the electrolyte on the surface of the stainless steel piece was washed water at room temperature.

(4) The stainless steel piece (304 substrate) was placed into an environment with a temperature of 55° C. and a humidity of 60% to harden for 3 hours. Thus, an anti-coking nanomaterial based on the stainless steel surface (304 substrate) was obtained.

The testing results of the anti-coking nanomaterial based on 304 stainless steel of the present invention were as follows: the nanocrystalline material contained 0.83% of carbon, 32.81% of oxygen, 44.28% of chromium, 14.47% of iron, 1.0% of molybdenum, 3.06% of nickel, 2.43% of silicon, 1.11% of calcium, and with the balance being remaining amount of impurity elements.

Example 6

An acid water stripping unit reflux system from Ningxia Coal Industry Group Co., Ltd. was seriously corroded, especially, the top reflux pipe, the return pump, the return tank and the condenser at the top of the tower had severe corrosion and serious leakage. The replacement of the equipment in the reflux system was short, which affected the acid water treatment of the equipment.

TABLE 14

Water analysis data after washing acids

| Items | Acid water stripping unit |
|---|---|
| Ammonia nitrogen in incoming water (mg/L) | 3900 |
| Sulfide in incoming water (mg/L) | 72 |
| Petroleum in incoming water (mg/L) | Not detected |
| COD in outer delivery water (mg/L) | did not cause excessive COD |
| Ammonia nitrogen in outer delivery water (mg/L) | 5-30 |
| Sulfide in outer delivery water (mg/L) | Not detected |
| Petroleum in outer delivery water (mg/L) | Not detected |
| PH in reflux | 8.6-10 |
| Iron ion in reflux (mg/L) | Total iron 39.6 |
| Cl— in reflux (mg/L) | Detected maximum was 11000 |
| Non-condensable gas $H_2S$ content (%) | <2 |
| Non-condensable gas $NH_4^+$ content (%) | Total nitrogen 50 |
| Non-condensable gas $CO_2$(%) | 50 |

Figure 6:
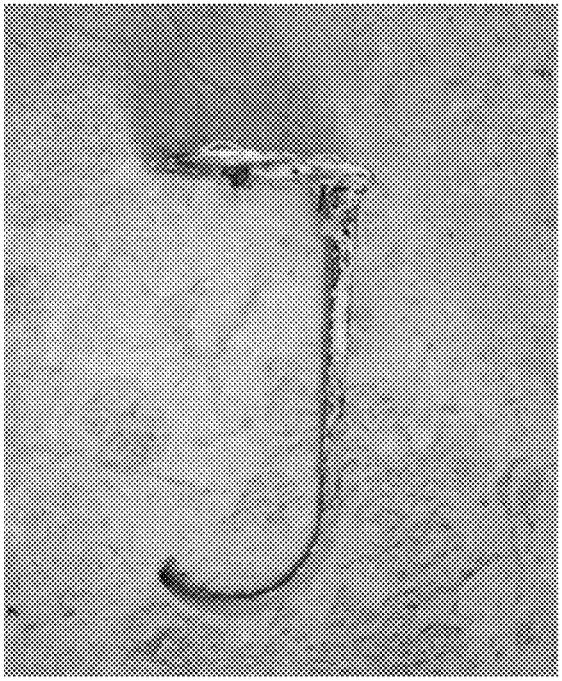
FIG. 6: a 304 stainless steel filter hanger (after being placed for 40 days)

Due to high content and fast flow rate of $Cl^-$ in the reflux of the acid water stripping unit reflux system and the caused washing and corrosion on the filter hanger piece was fast. When the filter hanger made of 304 stainless steel was tested, the result showed that there was visible corrosion to the naked eye after being placed for one week, as shown in FIG. 6. The 304 stainless steel filter mesh is corroded out and the whole skeleton structure is also corroded out after being placed for 40 days.

Figure 1:
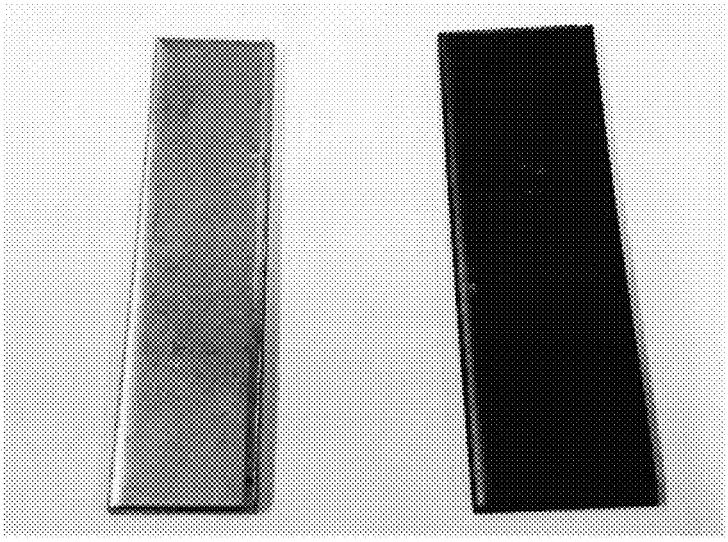
FIG. 1: the left side of the figure is a 304 stainless steel substrate, the right side of the figure is a 304 stainless steel substrate treated by the nanocrystalline material according to the present invention.
Figure 2:
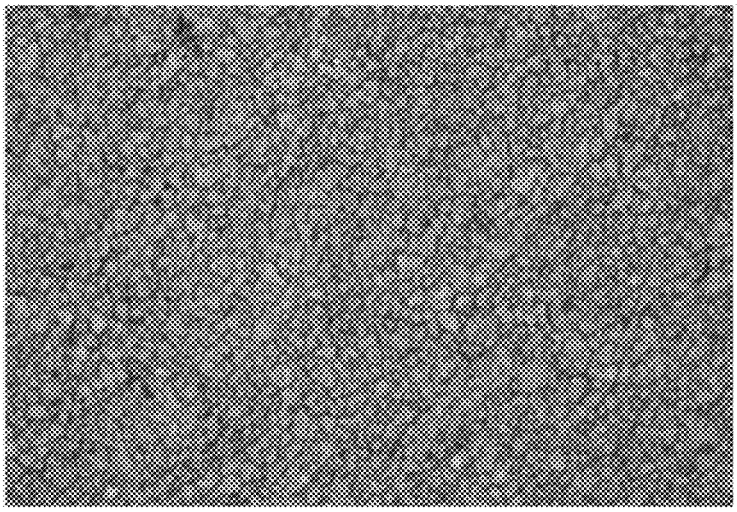
FIG. 2: a surface having the nanocrystalline material according to the present invention.
Figure 3:
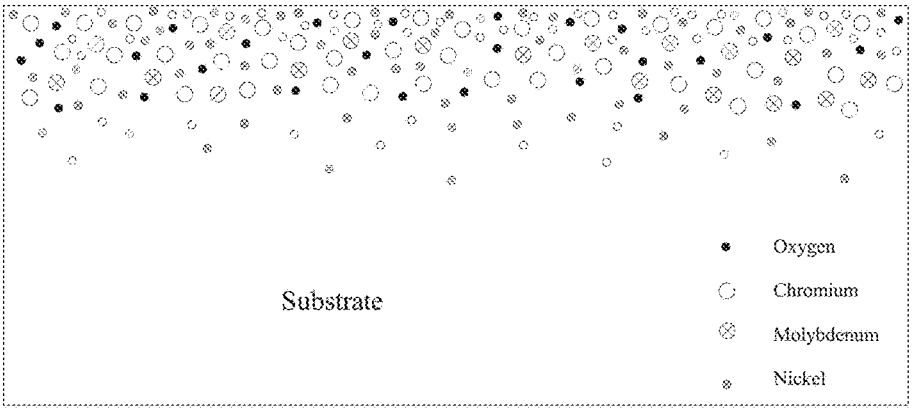
FIG. 3: a embedded element distribution diagram of the nanocrystalline material according to the present invention and 304 stainless steel substrate.
Figure 4:
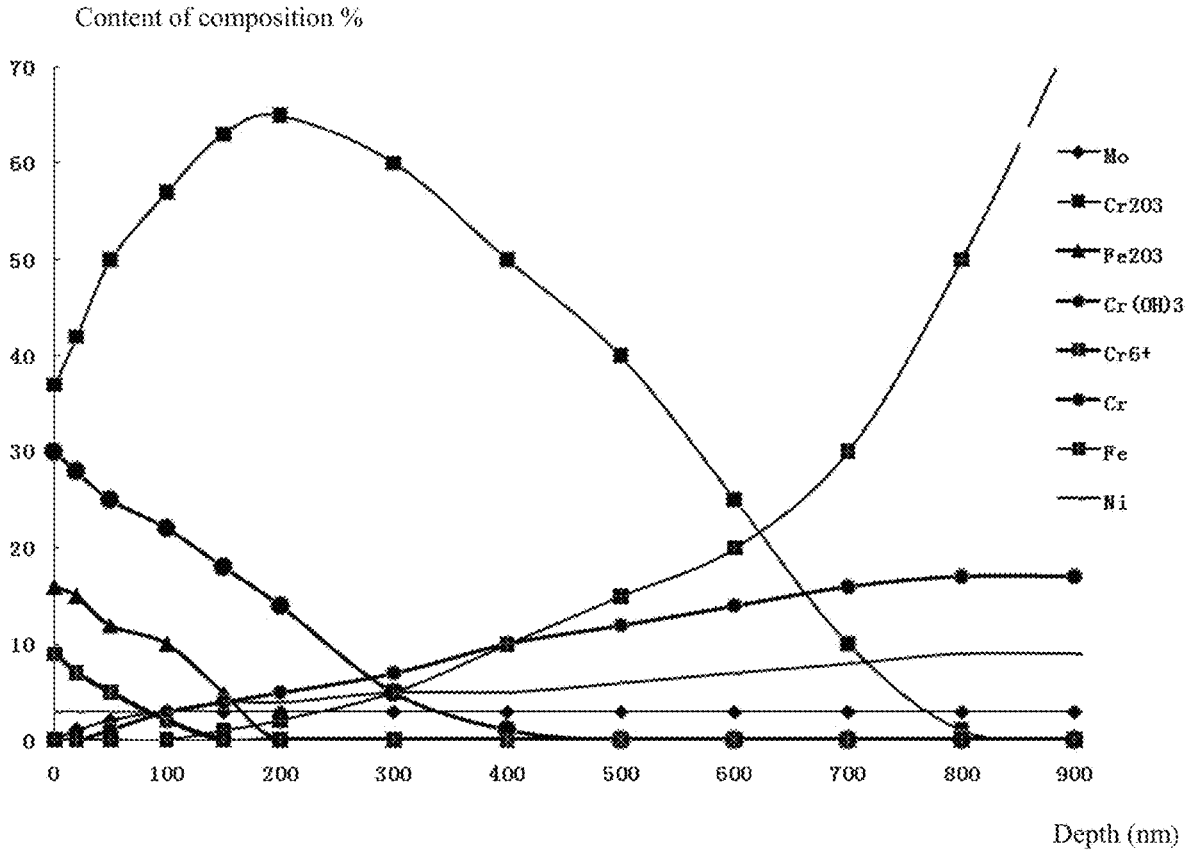
FIG. 4: a trend chart of material composition layer of the nanocrystalline material according to the present invention analyzed by X-ray photoelectron spectroscopy.
Figure 5:
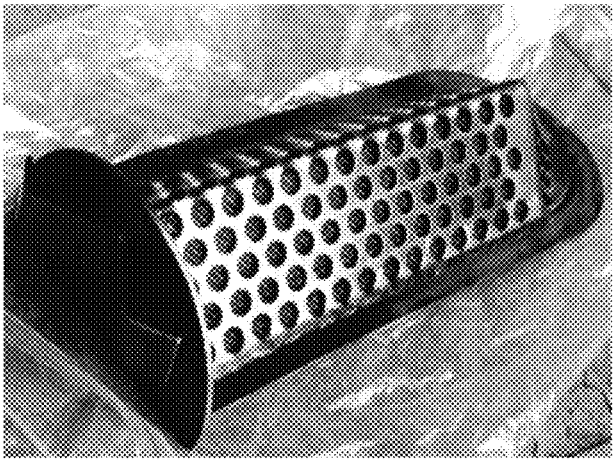
FIG. 5: a stainless steel filter hanger made of 304 stainless steel substrate treated by the nanocrystalline material according to the present invention.
Figure 7:
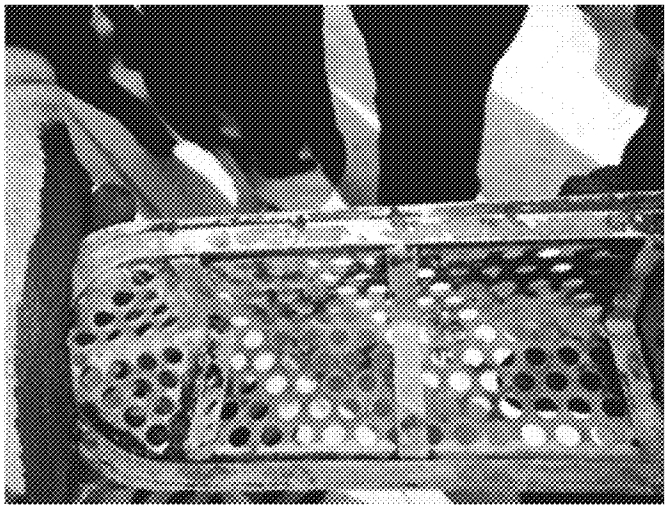
FIG. 7: a stainless steel filter hanger made of 304 stainless steel treated by the nanocrystalline material according to the present invention (after being placed for 40 days)
Figure 8:
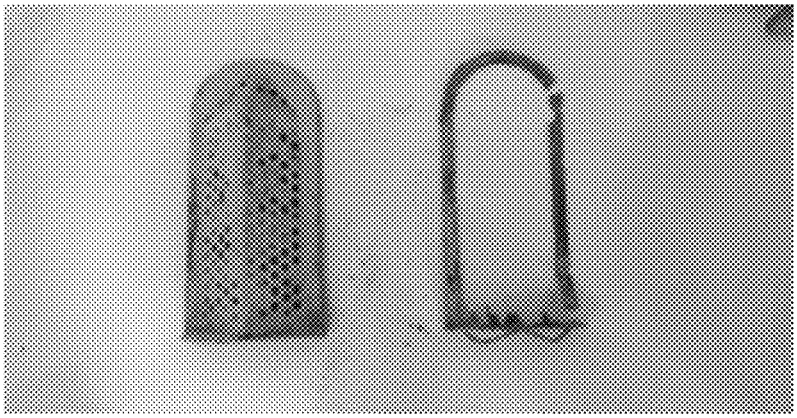
FIG. 8: the left side of the figure is a stainless steel filter hanger made of 304 stainless steel treated by the method according to the present invention (after being placed in an acid water stripper reflux pump for 3 months); the right part is a negative photograph of an ordinary 304 stainless steel filter hanger (after being placed in an acid water stripper reflux pump for 40 days)
Figure 9:
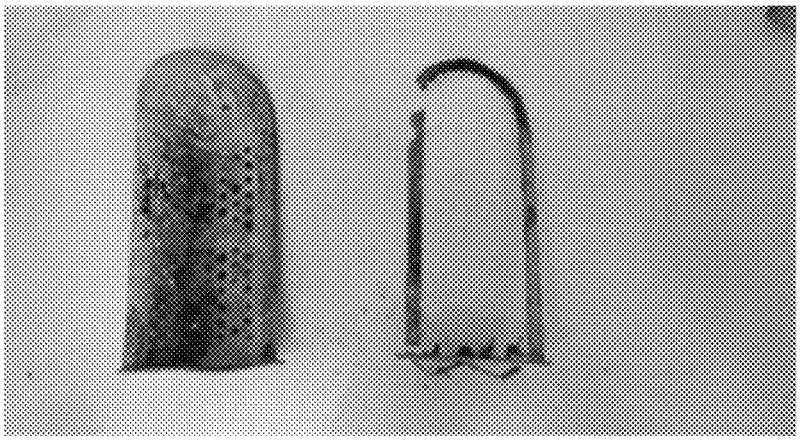
FIG. 9: the left side of the figure is a stainless steel filter hanger made of 304 stainless steel treated by the method according to the present invention (after being placed in an acid water stripper reflux pump for 3 months); the right part is a photograph of an ordinary 304 stainless steel filter hanger (after being placed in an acid water stripper reflux pump for 40 days)
Figure 10:
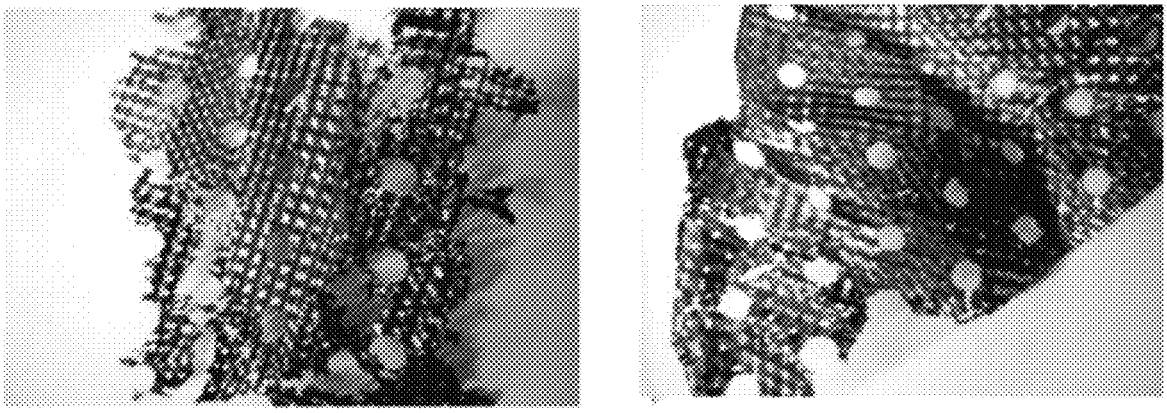
FIG. 10: an ordinary 304 stainless steel filler (after being operated for 1247 days)

After treating the 304 stainless steel by the nanocrystalline material according to the present invention, as shown in FIG. 5, the filter hanger was tested. The result showed that there was no any corrosion after being placed for one week. After being placed for 40 days, the stainless steel filter hanger embrittle, and the filter mesh can be broken by hand, but the overall skeleton structure and the filter mesh were kept intact, as shown in FIG. 7. The overall skeleton structure was still kept intact after being placed for 3 months, as shown in FIGS. 8-9.

Example 7

A branch company of China Petroleum & Chemical Corporation designed high-sulfur and high-acid crude oil as the crude oil in an atmospheric and vacuum distillation device of a crude oil deterioration reconstruction project. A 304 filter and a 304 filter containing a nano surface layer were placed at the bottom of the third section of a packed vacuum tower. Specific temperature was shown as Table 9:

TABLE 9

| Minus three lines temperature (° C.) | Sulfur content | Acid value | Carbon residue content |
|---|---|---|---|
| 213~331.2 | 0.77 m % | 1.06 | 2.26% |

Figure 11:
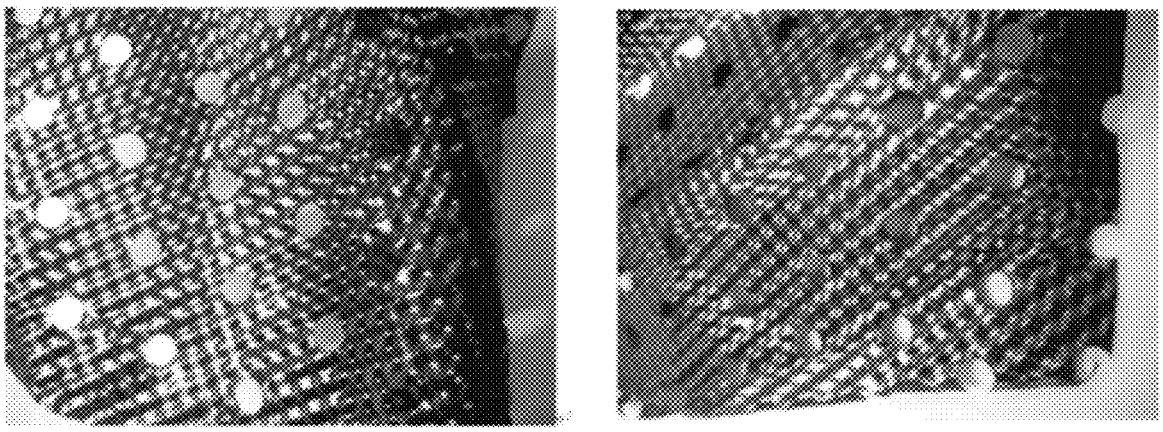
FIG. 11: a 304 stainless steel filler treated by the method according to the present invention (after being operated for 1247 days)

After being operated for 1247 days, it can be seen from the scene that the 304 substrate was corroded, become thin, and severely embrittled. While after being treated by the method according to the present invention, the stainless steel 304 showed no significant corrosion, as shown in FIG. 11.

Example 8

Figure 12:
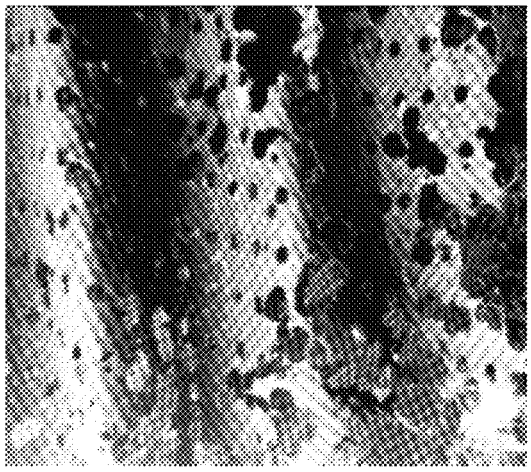
FIG. 12: a 317L stainless steel filler (after being operated for 3 years)
Figure 13:
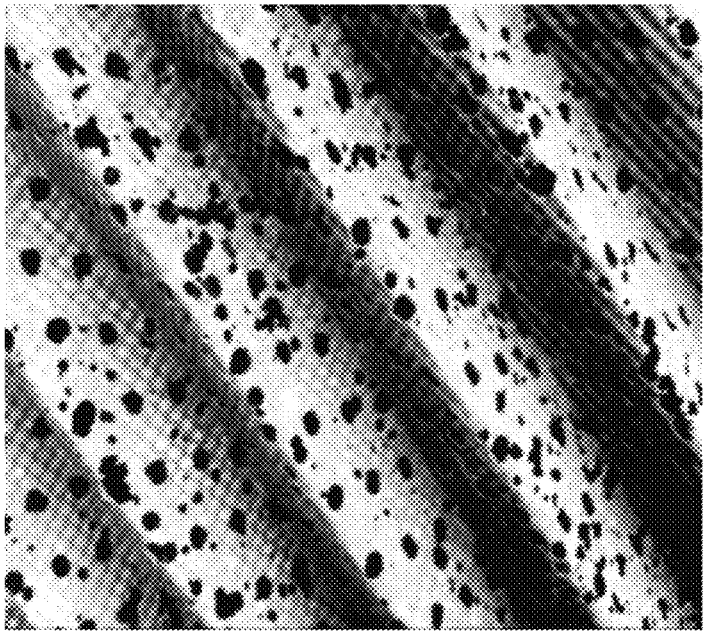
FIG. 13: adjacent area of a 317L stainless steel filler and a 317L stainless steel filler treated by the nanocrystalline material according to the present invention (after being operated for 3 years)
Figure 14:
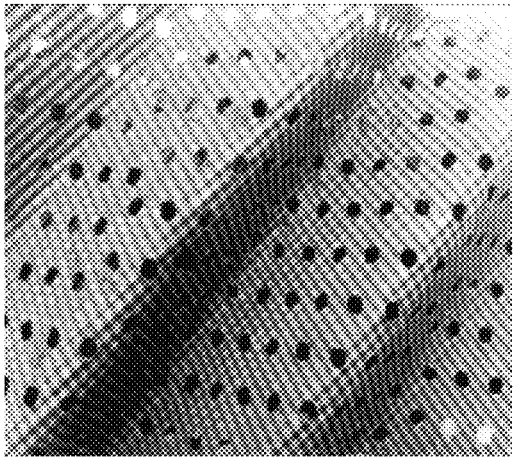
FIG. 14: a 317L stainless steel filler treated by the nanocrystalline material according to the present invention (after being operated for 3 years)

A branch company of China National Offshore Oil Corporation designed low-sulfur and high-acid crude oil as the crude oil in an atmospheric and vacuum distillation device. The temperature of the fifth section of the vacuum tower was 400° C., the sulfur content was 0.35%, the acid value was 2.65-3.09 and the filter substrate was 317L. After being operated for 3 years, it was seen from the scene that the 317L substrate had obvious corrosion, as shown in FIG. 12, the 317L substrate be adjacent to the nanofilm layer had corrosion, as shown in FIG. 13, while the 317L substrate treated by the method according to the present invention had no obvious corrosion with an intact surface film and visible gloss, as shown in FIG. 14.

The invention claimed is:

1. A method for preparing a nanocrystalline material, characterized in that the method comprises the following steps:

(1) chemically degreasing and etching with alkali a stainless steel surface using a sodium hydroxide solution and a solution containing an alkali etching active agent at 80-85° C. for 10-15 minutes, followed by washing with water;

(2) oxidizing the stainless steel surface treated in the step (1) by an oxidizing solution containing 200-300 g/L of $CrO_3$ and 100-150 g/L of $Na_2MoO_4$ with a temperature of 75-90° C. and a pH of 0.4-1.5, followed by washing with water;

(3) immersing the stainless steel surface treated in the step (2) as a cathode in an electrolyte containing 100-150 g/L of $CrO_3$, 100-150 g/L of $Na_2MoO_4$, 200-250 g/L of $H_3PO_4$, and 50-60 g/L of $Na_2SiO_3$ to electrolyze, followed by washing with water; and (4) placing the stainless steel surface treated in the step (3) at a temperature of 50-60° C. and a humidity of 60-70% for hardening for 3-4 hours;

expressed in percentage by weight, the nanocrystalline material contains 0-3% of carbon, 20-35% of oxygen, 40-53% of chromium, 10-35% of iron, 1-4% of molybdenum, 1-4% of nickel, 0-2.5% of silicon, 0-2% of calcium with the balance being impurity elements; and wherein in the step (3), a current for the electrolyzing is direct current; an intensity of the current is 40-5 $A/m^2$;

an initial current intensity is 40 $A/m^2$, and then the initial current intensity is gradually reduced to 5 $A/m^2$ according to the formula i=3+A/t, wherein i is current intensity, t is time, and A is parameter of 20-30; and the time for the electrolyzing is 25-55 minutes.

2. The method according to claim 1, characterized in that, in the step (1), a concentration of the sodium hydroxide solution is 6.5-8%.

3. The method according to claim 1, characterized in that, in the step (2), the pH of the oxidizing solution is adjusted by adding a 98% $H_2SO_4$ solution into the oxidizing solution.

4. The method according to claim 1, characterized in that, in the step (3), a temperature of the electrolyte is 40-52° C.

5. The method according to claim 1, characterized in that the amount of the impurity elements is <1%;

the nanocrystalline material contains, expressed in percentage by weight, 0.83% of carbon, 32.81% of oxygen, 44.28% of chromium, 14.47% of iron, 1.0% of molybdenum, 3.06% of nickel, 2.43% of silicon, 1.11% of calcium with the balance being the impurity elements.

6. The method according to claim 1, characterized in that a friction coefficient μ of the nanocrystalline material is 0.07-0.098.

7. The method according to claim 1, characterized in that a friction coefficient μ of the nanocrystalline material is 0.092.

8. The method according to claim 1, characterized in that, in the step (1), a concentration of the solution containing the alkali etching active agent is 0.3-0.5%.

9. The method according to claim 1, characterized in that, in the step (1), the alkali etching active agent is ethoxy modified polytrisiloxane.

10. The method according to claim 1, characterized in that, in the step (1), the washing with water is performed by using water with a temperature of 80-85° C. for 3-5 minutes.

11. The method according to claim 1, characterized in that, in the step (2), a time for the oxidizing is 15-35 minutes.

12. The method according to claim 1, characterized in that, in the step (2), the washing with water in the step (2) is performed cyclically by using water with a pH of >3 at 25-40° C. for 3-5 minutes.

13. The method according to claim 1, characterized in that, in the step (3), a pH of the electrolyte is adjusted to 0.5-1.5 by adding a 98% $H_2SO_4$ solution into the electrolyte.

14. The method according to claim 1, characterized in that, in the step (3), the electrolyzing comprises electrolyzing for 10-25 minutes at the initial current intensity of 40 $A/m^2$, and then gradually reducing the initial current intensity to 5 $A/m^2$ during 15-30 minutes while during the electrolyzing.

15. The method according to claim 1, characterized in that, in the step (3), the washing with water is performed cyclically by using water at 25-40° C. for 3-5 minutes, and the water has a pH of >3.

* * * * *